US005509734A

United States Patent [19]

Ausnit

[11] Patent Number: 5,509,734

[45] Date of Patent: Apr. 23, 1996

[54] WEDGE ACTIVATED ZIPPER

[75] Inventor: Steven Ausnit, New York, N.Y.

[73] Assignee: Minigrip, Inc., Orangeburg, N.Y.

[21] Appl. No.: 179,919

[22] Filed: Jan. 11, 1994

[51] Int. Cl.[6] ..... B65D 33/24

[52] U.S. Cl. ..... 383/63; 24/587

[58] Field of Search ..... 383/63, 64, 65; 24/587

[56] References Cited

U.S. PATENT DOCUMENTS

| | | | |
|---|---|---|---|
| 3,038,225 | 6/1962 | Ausnit | 24/587 |
| 3,372,442 | 3/1968 | Ishimatsu | 383/63 |
| 3,410,327 | 11/1968 | Ausnit | 383/63 |
| 4,710,968 | 12/1987 | Borchardt et al. | 383/63 |
| 4,854,017 | 8/1989 | Kamp | 383/63 |
| 5,140,727 | 8/1992 | Dais et al. | 383/65 |
| 5,209,574 | 5/1993 | Tilman | 383/65 |
| 5,211,481 | 5/1993 | Tilman | 383/63 |
| 5,248,201 | 9/1993 | Kettner et al. | 383/63 |
| 5,368,394 | 11/1994 | Scott et al. | 383/65 |
| 5,403,094 | 4/1995 | Tomic | 383/63 |

*Primary Examiner*—Stephen P. Garbe

*Attorney, Agent, or Firm*—Kane, Dalsimer, Sullivan, Kurucz, Levy, Eisele & Richard

[57] ABSTRACT

A reclosable bag is formed of walls defining a closure with a mouth. The walls have interlocking profiles on their internal surfaces adjacent to the mouth to enable the bag to be sealed. One of the two profiles has a spreader which fits between and spreads the interlocking members on the other profile to bring about a more effective sealing of the bag.

34 Claims, 5 Drawing Sheets

WEDGE ACTIVATED ZIPPER

BACKGROUND OF THE INVENTION

1. Field of The Invention

This invention pertains to the art of reclosable plastic bags having extruded zippers, and more particularly to fastener profiles which interlock with one another to seal such bags. More specifically, one of the two fastener profiles on either side of the bag opening has a spreader, which may be wedge-shaped, and which fits into a space between interlocking members on the other of the two fastener profiles to spread them apart relative to one another, so that they may be more firmly interlocked with those on the other fastener profile when the bag is sealed.

2. Description of the Prior Art

Reclosable bags used, for example, for storing household foodstuffs are typically made of polyethylene. As shown in U.S. Pat. No. 3,416,199 to Imamura commonly assigned with the present invention, a reclosable bag may be formed of two opposed walls equipped at the mouth with fastener profiles. These profiles may include a male profile attached to one wall and a female profile attached to the other wall, or interlocking rib and groove members on the two walls, or interlocking hooks on the two walls. In all of these possible forms, the profiles are shaped so that, when they are aligned and pressed together into an engaging relationship, they form a continuous closure for the bag. The bag may be opened by pulling the walls apart thereby separating the profiles. Various geometric shapes and arrangements for such profiles are shown in U.S. Pat. Nos. Re. 28,969; 3,323,707; 4,212,337; 4,363,345; 4,561,108; and 4,812,056, as well as in U.S. Pat. Nos. 2,558,367; 2,780,261; 2,606,351 and 3,054,434. In addition, U.S. Pat. Nos. 4,736,496 and 5,012,561 disclose reclosable bags with profiles and internal ribs adjacent to the profiles. U.S. Pat. No. 4,822,539 discloses a reclosable bag with interlocking profiles, internal guiding ribs disposed adjacent to the profiles, and stabilizing beams disposed on the outside surface of the bag wall. U.S. Pat. No. 3,338,285 discloses a reclosable bag having several parallel interlocking male and female profiles. In general, the profiles must be such as to provide relatively high resistance to opening from inside the bag while rendering the bag relatively easy to open from the outside.

Other relevant patents are U.S. Pat. Nos. 3,038,225; 3,372,442; and 3,410,327 The first of these, U.S. Pat. No. 3,038,225, shows a separable fastener which includes a wedge-shaped projection. U.S. Pat. No. 3,410,327 shows a profile which is easier to open from the outside than from the inside.

Finally, U.S. Pat. No. 5,140,727 shows a zipper for a reclosable plastic bag wherein a part of at least one of the interlockable rib and groove profiles is structurally discontinuous along its length and substantially free of interdigitation with the opposing profile when interlocked therewith. The structural discontinuities impart a vibratory or bumpy feel perceptible to the touch or an audible clicking sound continually therealong when the profiles are interlocked or separated from each other.

SUMMARY OF THE INVENTION

In view of the above, an objective of the present invention is to provide a reclosable bag with improved closure means.

Other objectives and advantages of the invention will become apparent from the description to follow. A reclosable bag constructed in accordance with the present invention includes a first wall and a second wall joined to form an enclosure with a mouth defined by wall edges and first and second profile means for selectively opening and sealing the mouth. The first and second profiles, extending along the internal surfaces of the first and second walls, respectively, interengage with one another when the bag is sealed.

The first profile has a first interlocking member, a second interlocking member and a spreader disposed therebetween. The second profile has a first interlocking member and a second interlocking member which interengage with their corresponding interlocking members on the first profile to seal the bag. The spreader fits between and separates the first and second interlocking members on the second-profile when the bag is sealed to render the seal more effective.

The spreader improves the waterproof characteristics of the profiles, and may be extruded from a higher flow material, such as ethylene vinyl acetate (EVA), to ensure better end seals. Such a material will prevent the occurrence of pin holes at the spreader location. The spreader may also be shaped to increase the force required to open the fastener from inside the bag. Further, as the fastener construction is wider, it will be easier to interlock.

The present invention will now be described in more complete detail in the paragraphs to follow, where reference will be made to the several figures identified below.

DETAILED DESCRIPTION OF THE PREFERRED EMBODIMENTS

Figure 1:
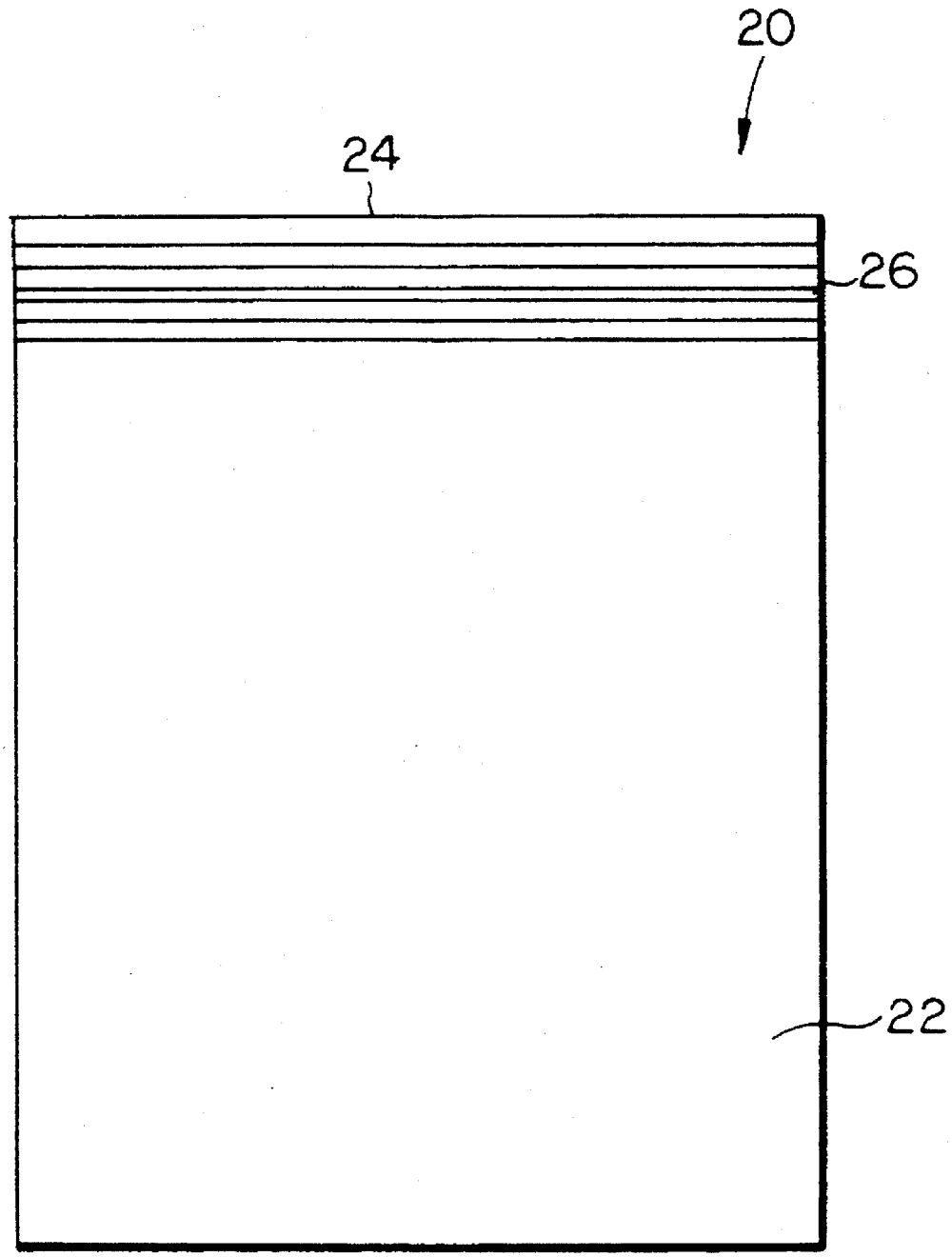
FIG. 1 shows a plan view of a reclosable bag constructed in accordance with the present invention.

Referring now to the drawings, a reclosable bag 20 constructed in accordance with the present invention includes front wall 22 and rear wall, not shown, seamed along three edges thereby forming an enclosure with an opening or mouth 24 along the top or fourth edge. The bag 20 is preferably made of a thermoplastic material, such as polyethylene, by extrusion. Attached to the internal faces of front wall 22 and the back wall are profiles 26, which extend continuously from side to side of the bag 20. The profiles serve to seal the mouth 24 when they are interlocked with one another.

Figure 2:
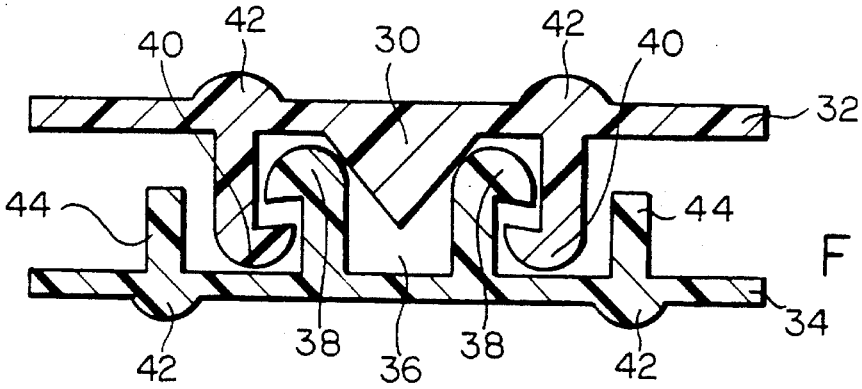
FIG. 2 is a cross-sectional view of a first embodiment of the interlocking profiles of the present invention.

A first embodiment of the zipper profiles of the present invention may be seen in FIG. 2. Generally stated, one of the two profiles in all embodiments of the invention has a spreader, which in FIG. 2 is a wedge 30. The other of the two profiles has at least one interlocking member, which consists of a rib with a hook element at its end and which interlocks with a corresponding member on the profile having the spreader when the bag is sealed. The spreader moves the interlocking member or members on the other profile apart to bring about a more positive interlocking therebetween.

Referring now more specifically to FIG. 2, a first profile 32 includes a spreader in the form of wedge 30. A second profile 34 includes a space 36 to accommodate the wedge 30. The second profile 34 has a pair of ribs with interlocking hooks 38 facing away from the space 36. The first profile 32, on the other hand, has a pair of ribs with interlocking hooks 40 facing toward the wedge 30. When the first profile 32 and second profile 34 are interlocked with one another, as shown in FIG. 2, the wedge 30 spreads interlocking hooks 38 apart to bring them into a more positive interlocked condition with interlocking hooks 40.

Both the first profile 32 and the second profile 34 in this and all other embodiments of the present invention may include guide ribs 42, which give the zipper a wide-track feel and which serve as a guide to the fingers of a person sealing the bag indicating that the first profile 32 and the second profile 34 are properly aligned.

The second profile 34 may also include guide posts 44, which also facilitate the proper interlocking of the first profile 32 and the second profile 34 when the bag is being sealed.

Figure 3:
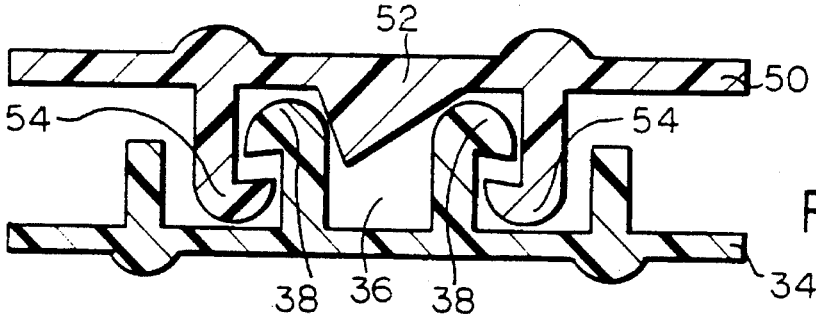
FIG. 3 is a cross-sectional view of a second such embodiment.

The next several embodiments to be discussed differ from one another with respect to the shape of the spreader. Referring to FIG. 3, a first profile 50 includes a non-symmetric wedge 52. The second profile 34 is identical to that shown in FIG. 2. Non-symmetric wedge 52 has the effect of making the force required to separate the first profile 50 from the second profile 34 different when opened from the left or right sides in the figure. That is to say, the force required to separate the first profile 50 from the second profile 34 from the left is larger than that from the right. Profiles such as those shown in FIG. 3 may be useful in situations where unintended openings of a reclosable bag from inside are to be further inhibited. In such situations, the left side of the profiles shown in FIG. 3 would be on the inside of the bag opening, as the non-symmetric wedge 52 will make it more difficult for the left interlocking hook 38 to be freed from corresponding interlocking hook 54, than for the right interlocking hook 38 to be freed from its corresponding interlocking hook 54.

Figure 4:
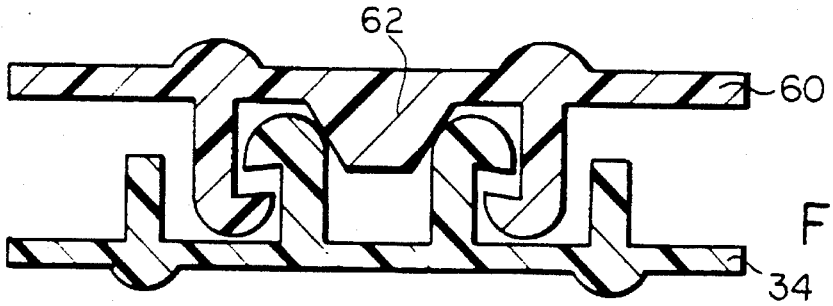
FIG. 4 is a cross-sectional view of a third such embodiment.

With reference to FIG. 4, a first profile 60 includes a flattened wedge 62, or one which has not been provided with an apex. The second profile 34 is identical to that shown previously. It may be easier to indent a wedge 62 of this flattened type in the manner to be shown below than to indent wedges 30,52 shown in FIGS. 2 and 3, respectively.

Figure 5:
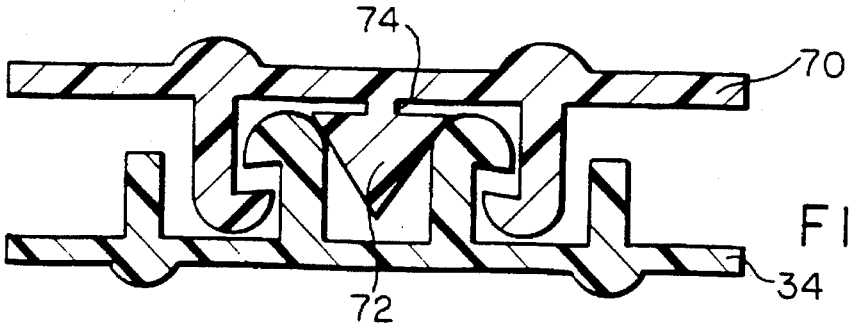
FIG. 5 is a cross-sectional view of a fourth such embodiment.

Referring to FIG. 5, a first profile 70 includes an arrowhead-shaped spreader 72. The second profile 34 is again identical to that previously shown. The arrowhead-shaped spreader 72 may be susceptible to fewer problems during the extrusion process, since the mass of the spreader is separated from the balance of the first profile 70 by neck 74.

Figure 6:
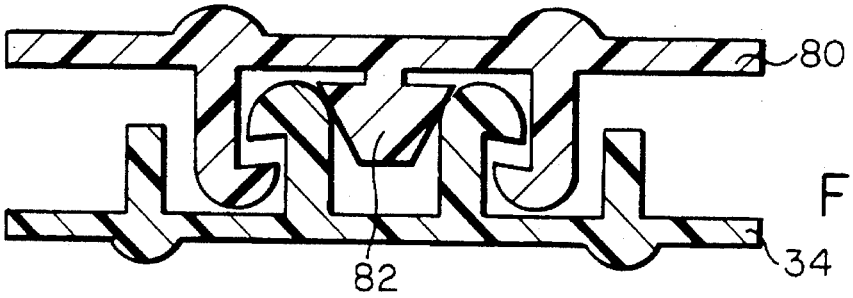
FIG. 6 is a cross-sectional view of a fifth such embodiment.

In FIG. 6, a variation of the embodiment shown in FIG. 5 is shown. There, a first profile 80 includes a flattened arrowhead-shaped spreader 82. The second profile 34 remains the same as that shown in previous figures. The flattened arrowhead-shaped spreader 82 may be even less susceptible to problems during the extrusion process than arrowhead-shaped spreader 72.

Figure 7:
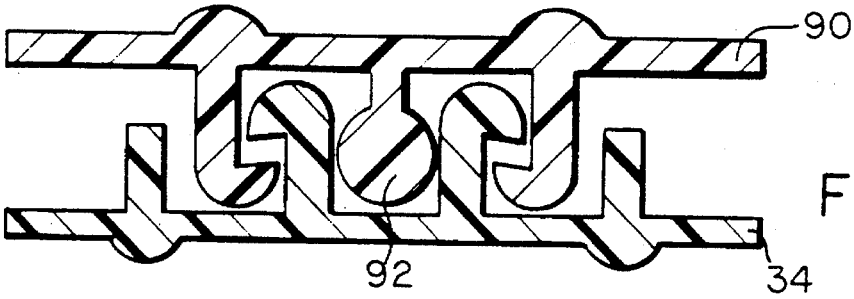
FIG. 7 is a cross-sectional view of a sixth such embodiment.

In FIG. 7, a first profile 90 includes a cylindrical spreader 92. The second profile 34 again remains the same as that shown in previous figures.

Figure 8:
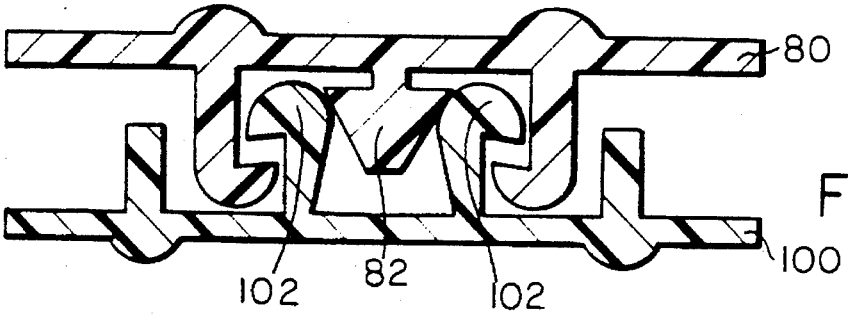
FIG. 8 is a cross-sectional view of a seventh such embodiment.

Referring to FIG. 8, a first profile 80 having a flattened arrowhead-shaped spreader 82 identical to that shown in FIG. 6 is interlocked with a second profile 100 having ribs with inwardly sloping surfaces ending in interlocking hooks 102 to ensure a more resilient cooperation with spreader 82.

Figure 9:
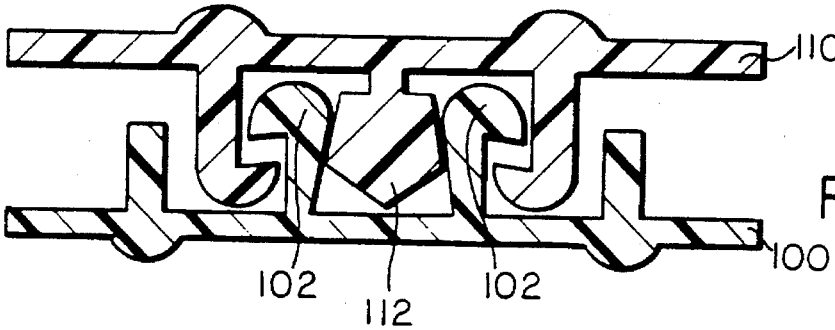
FIG. 9 is a cross-sectional view of an eighth such embodiment.

In FIG. 9, the second profile 100 having ribs with inwardly sloping surfaces ending in interlocking hooks 102 is identical to that shown in FIG. 8. A first profile 110 has a pentagonal spreader 112 which cooperates with the inwardly sloping surfaces of the ribs ending in interlocking hooks 102 to maintain the first profile 110 and second profile 100 in an interlocked state.

Figure 10:
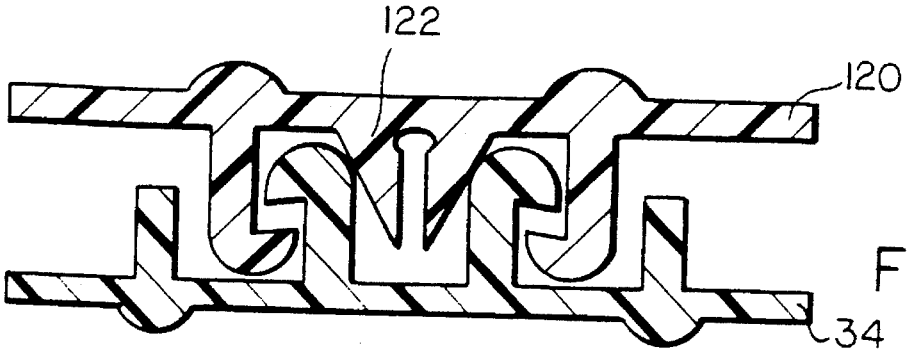
FIG. 10 is a cross-sectional view of a ninth such embodiment.

With reference to FIG. 10, a first profile 120 may be interlocked with a second profile 34 of the variety previously shown in FIGS. 2, 3, 4, 5, 6, and 7. The first profile 120 has a spreader in the form of a split wedge 122. The split wedge 122 due to its reduced mass may be susceptible to fewer problems during the extrusion process.

Figure 11:
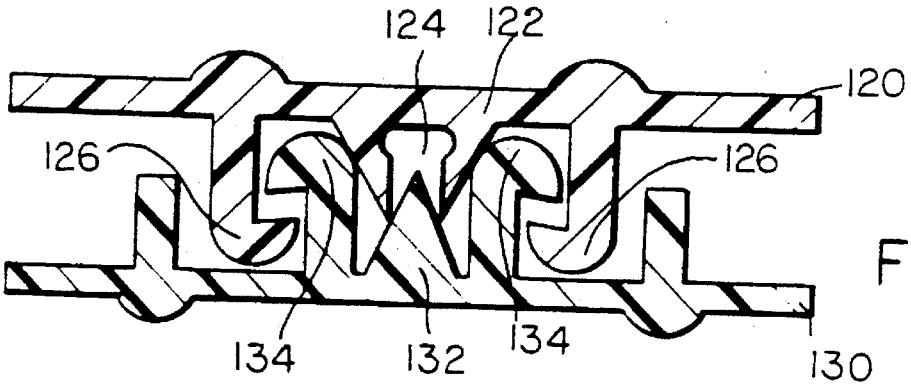
FIG. 11 is a cross-sectional view of a tenth such embodiment.

With reference to FIG. 11, a first profile 120, having a spreader in the form of a split wedge 122 as previously shown in FIG. 10, is shown interlocked with the second profile 130 which also has a spreader 132 in the shape of wedge located between interlocking hooks 134. As may be clearly observed in FIG. 11, wedge 132 extends into the split 124 in split wedge 122 to spread split wedge 122, which in turn spreads interlocking hooks 134 into more effective engagement with interlocking hooks 126.

Figure 12:
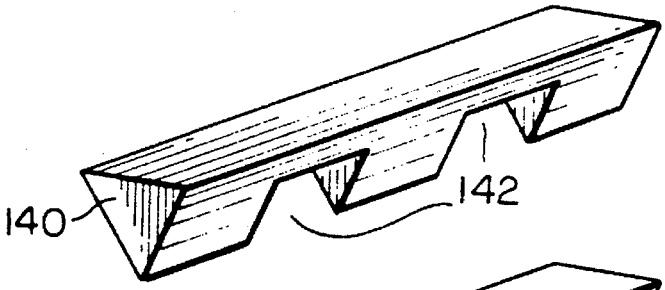
FIG. 12 is a perspective view of an alternate construction of the wedge portion of the profiles of the present invention.
Figure 13:
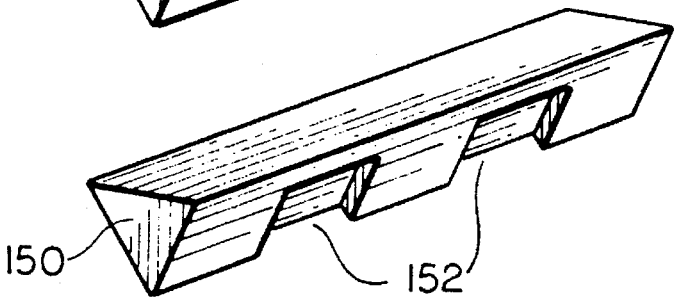
FIG. 13 is a perspective view of yet another alternate construction of the wedge portion.

With reference to FIGS. 12 and 13, the spreaders of the profiles of the present invention may be provided with transverse cutouts or indentations to enable them to create a clicking sound when they come into contact with the opposing interlocking members. For the purpose of illustration, spreaders in the form of wedges are shown in FIGS. 12 and 13. In FIG. 12, wedge 140 is provided with transverse cutouts 142. Wedge 150 in FIG. 13 has transverse indentations 152. Where such indentations 152 are provided, they may be in back-to-back positions on both sides of wedge 150, or they may alternate in a staggered fashion along the length of the wedge 150.

Figure 14:
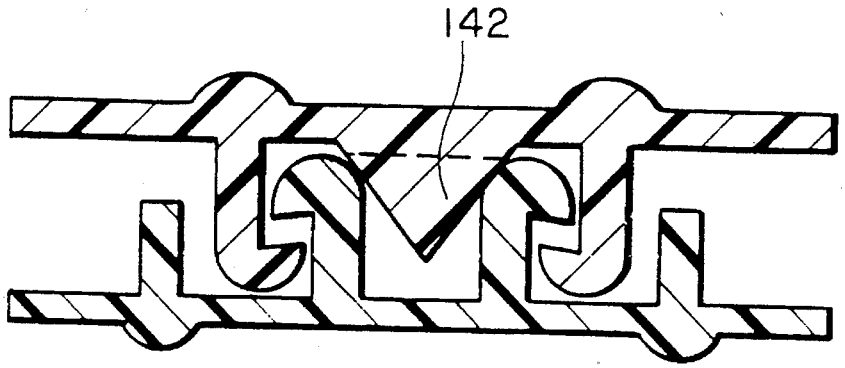
FIG. 14 is a cross-sectional view of the first embodiment including the alternate wedge portion shown in FIG. 12.
Figure 15:
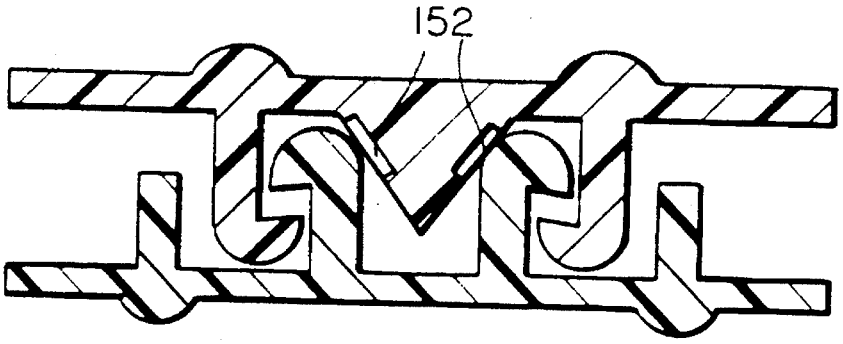
FIG. 15 is a cross-sectional view of the first embodiment including the alternate wedge portion shown in FIG. 13.
Figure 16:
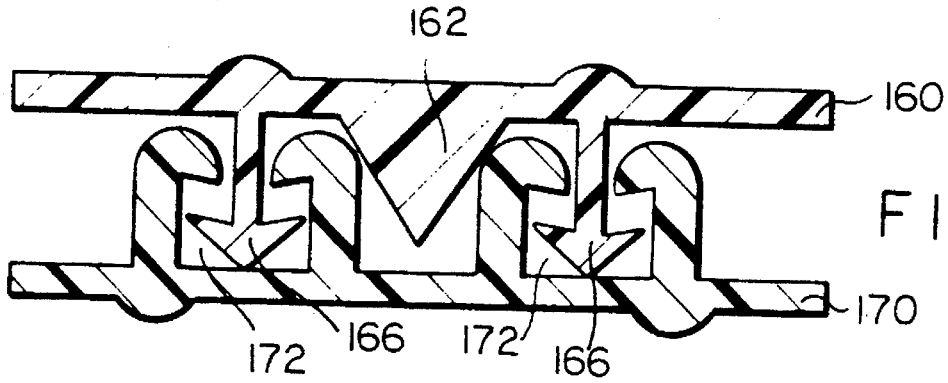
FIG. 16 is a cross-sectional view of an eleventh embodiment of the interlocking profiles of the present invention.

The use of cutouts such as 142 is shown in FIG. 14, while indentations such as 152 are shown in FIG. 15. The profiles shown in FIG. 16 are rather different from those shown in previous figures. A first profile 160 has a spreader in the form of a wedge 162. The first profile 160 has a male profile member 166 on each side of the wedge 162. The second profile 170 has two female profile members 172, which interlock with male profile members 166. Wedge 162 spreads female profile members 172 apart so that they may more positively interlock with male profile members 166. Transverse cutouts or indentations may be provided on wedge 162 to create a clicking sound when the profiles are interlocked.

It should be understood that clarity has been the primary concern in the preparation of the above-described figures. Specifically, the dimensions and relative separations of the elements of the profiles may have been exaggerated in order to communicate clearly what is considered to be the invention.

It should further be understood that the profiles shown in FIGS. 2 through 16 may be extruded unitarily with the walls of the bag 20, such that the profiles may be an integral part of the walls of the bag. Alternatively, the profiles may be extruded separately, and then may be bonded to sheets of bag forming material at some stage in the bag forming operation. It should further be understood that the spreader may be made of the same material as the balance of the first profile or of a different material.

Clearly, numerous modifications may be made to the present invention without departing from its scope as defined in the appended claims.

What is claimed is:

1. A reclosable bag comprising:

a first wall and a second wall joined to form an enclosure with a mouth defined by wall edges; and a closure for selectively opening and sealing said mouth, said closure comprising a first profile extending along an internal surface of said first wall and a second profile adapted to interengage with said first profile and extending along an internal surface of said second wall, wherein said first profile has a first interlocking member, a second interlocking member and a spreader comprising a first wedge extending longitudinally along said first profile between said first and second interlocking members, and wherein said second profile has a first interlocking member and a second interlocking member spaced apart from said first interlocking member along said second wall, said second profile first and second interlocking members interengaging with said first and second interlocking members, respectively, of said first profile to interengage said first and second profiles, said spreader on said first profile occupying a portion of the space between said second profile interlocking members to further separate said first and second interlocking members on said second profile from one another after said first and second profiles are interengaged, so that said first and second profiles may be more effectively interengaged when said reclosable bag is closed.

2. A reclosable bag as claimed in claim 1 wherein said first profile further comprises a first and a second guide rib, said first and second guide ribs being disposed on a side of said first profile facing away from said second profile.

3. A reclosable bag as claimed in claim 1 wherein said second profile further comprises a first and a second guide rib, said first and second guide ribs being disposed on a side of said second profile facing away from said first profile.

4. A reclosable bag as claimed in claim 1 wherein said first wedge has a triangular cross section.

5. A reclosable bag as claimed in claim 1 wherein said first wedge has a non-symmetric cross section.

6. A reclosable bag as claimed in claim 1 wherein said first wedge has a flattened apex.

7. A reclosable bag as claimed in claim 1 wherein said first wedge has a longitudinal split extending across said first profile.

8. A reclosable bag as claimed in claim 7 wherein said second profile further comprises a second wedge between said first and second interlocking members thereof, said second wedge extending longitudinally along said second profile between said first and second interlocking members thereof, said second wedge extending into said split in said first wedge and widening said split when said first and second profiles are interengaged.

9. A reclosable bag as claimed in claim 1 wherein said spreader has transverse cutouts provided at longitudinally spaced intervals across said first profile.

10. A reclosable bag as claimed in claim 1 wherein said spreader has transverse indentions provided at longitudinally spaced intervals across said first profile.

11. A reclosable bag as claimed in claim 10 wherein said transverse indentations are on both sides of said spreader and face both said first and second interlocking members of said first profile.

12. A reclosable bag as claimed in claim 11 wherein said transverse indentations are in a back-to-back relationship on said spreader.

13. A reclosable bag as claimed in claim 11 wherein said transverse indentations are in a staggered relationship on said spreader.

14. A reclosable bag as claimed in claim 1 wherein said first and second interlocking members on said first profile, and said first and second interlocking members on said second profile are interlocking hooks.

15. A reclosable bag as claimed in claim 14 wherein said second profile further comprises a first and a second guide post, said first guide post being adjacent to said first interlocking member of said first profile and defining a space for said first interlocking member, and said second guide post being adjacent to said second interlocking member of said first profile and defining a space for said second interlocking member.

16. A reclosable bag as claimed in claim 1 wherein said first and second interlocking members on said first profile are male profile members, and said first and second interlocking members on said second profile are female profile members,

17. A reclosable bag as claimed in claim 1 wherein said spreader is made of a material different from the rest of said first profile.

18. A closure for selectively opening and sealing a container, said closure comprising:

a first profile and a second profile adapted to interengage with said first profile, wherein said first profile has a first interlocking member, a second interlocking member and a spreader comprising a first wedge extending longitudinally along said first profile between said first and second interlocking members, and wherein said second profile has a first interlocking member and a second interlocking member spaced .apart from said first interlocking member along said second wall, said second profile first and second interlocking members interengaging with said first and second interlocking members, respectively, of said first profile to interengage said first and second profiles, said spreader on said first profile occupying a portion of the space between said second profile interlocking members to further separate said first and second interlocking members on said second profile from one another after said first and second profiles are interengaged, so that said first and second profiles may be more effectively interengaged when said container is sealed.

19. A closure as claimed in claim 18 wherein said first profile further comprises a first and a second guide rib, said first and second guide ribs being disposed on a side of said first profile facing away from said second profile.

20. A closure as claimed in claim 18 wherein said second profile further comprises a first and a second guide rib, said first and second guide ribs being disposed on a side of said second profile facing away from said first profile.

21. A closure as claimed in claim 18 wherein said first wedge has a triangular cross section.

22. A closure as claimed in claim 18 wherein said first wedge has a non-symmetric cross section.

23. A closure as claimed in claim 18 wherein said first wedge has a flattened apex.

24. A closure as claimed in claim 18 wherein said first wedge has a longitudinal split extending across said first profile.

25. A closure bag as claimed in claim 24 wherein said second profile further comprises a second wedge between said first and second interlocking members thereof, said second wedge extending longitudinally along said second profile between said first and second interlocking members thereof, said second wedge extending into said split in said first wedge and widening said split when said first and second profiles are interengaged.

26. A closure as claimed in claim 18 wherein said spreader has transverse cutouts provided at longitudinally spaced intervals across said first profile.

27. A closure as claimed in claim 18 wherein said spreader has transverse indentions provided at longitudinally spaced intervals across said first profile.

28. A closure as claimed in claim 27 wherein said transverse indentations are on both sides of said spreader and face both said first and second interlocking members of said first profile.

29. A closure as claimed in claim 28 wherein said transverse indentations are in a back-to-back relationship on said spreader.

30. A closure as claimed in claim 28 wherein said transverse indentations are in a staggered relationship on said spreader.

31. A closure as claimed in claim 18 wherein said first and second interlocking members on said first profile, and said first and second interlocking members on said second profile are interlocking hooks.

32. A closure as claimed in claim 31 wherein said second profile further comprises a first and a second guide post, said first guide post being adjacent to said first interlocking member of said first profile and defining a space for said first interlocking member, and said second guide post being adjacent to said second interlocking member of said first profile and defining a space for said second interlocking member.

33. A closure as claimed in claim 18 wherein said first and second interlocking members on said first profile are male profile members, and said first and second interlocking members on said second profile are female profile members.

34. A closure as claimed in claim 18 wherein said spreader is made of a material different from the rest of said first profile.

* * * * *